United States Patent [19]

Bleckmann et al.

[11] Patent Number: 4,635,549

[45] Date of Patent: Jan. 13, 1987

[54] METHOD FOR CLOSING THE GAP BETWEEN THE ENDS OF GRAVURE PRINTING PLATES CLAMPED ON FORME CLYINDERS

[75] Inventors: Gerhard Bleckmann, Lampertheim; John Lynch, Monsheim; Günter Wallbillich, Neustadt, all of Fed. Rep. of Germany

[73] Assignee: BASF Aktiengesellschaft, Ludwigshafen, Fed. Rep. of Germany

[21] Appl. No.: 772,661

[22] Filed: Sep. 5, 1985

[30] Foreign Application Priority Data

Sep. 8, 1984 [DE] Fed. Rep. of Germany ..... 3433046

[51] Int. Cl.[4] ..... B41C 1/02; B41F 27/06

[52] U.S. Cl. ..... 101/401.1; 101/415.1; 277/1

[58] Field of Search ..... 101/415.1, 378, 426, 101/401.1; 277/1, 9.5

[56] References Cited

U.S. PATENT DOCUMENTS 4,515,375 5/1985 Bleckmann et al. ..... 101/415.1

*Primary Examiner*—E. H. Eickholt

*Attorney, Agent, or Firm*—Keil & Weinkauf

[57] ABSTRACT

To close the gaps (6) which result between the end or edge sections (7) of the gravure printing plates (2) when the latter are clamped on form cylinders (1) of rotary gravure presses, the gap (6) is covered with a cover element (8) in which at least that surface region which lies on the end or edge sections (7) of the gravure printing plate (2) and covers the gap (6) is deformable under pressure and can therefore be matched up with the surface contour in the gap region, the cover element is pressed onto the surface of the gravure printing plate, the resulting gap cavity is filled with a curable filling compound and, when curing of the filling compound is complete, the cover element is removed. It is particularly advantageous to use cover elements which are in the form of hollow bodies and which are filled with a pressure-generating and pressure-transmitting medium, and the pressure exerted on the deformable surface of the cover element which lies on the gravure printing plate, and hence also the surface contour of the closed gap, can be controlled via the internal pressure in the cavity of the cover element.

8 Claims, 2 Drawing Figures

METHOD FOR CLOSING THE GAP BETWEEN THE ENDS OF GRAVURE PRINTING PLATES CLAMPED ON FORME CLYINDERS

The present invention relates to a method for closing the gaps which occur between the end or edge regions of gravure printing plates when the latter are clamped on a forme cylinder of a sheet-fed or web-fed rotary gravure press. In this method, the gap to be closed is covered flush with the adjacent surfaces of the gravure printing plate by means of a cover element by placing the latter on the end sections of the gravure printing plate and pressing the said element onto the surface of this plate, the resulting gap cavity is filled with a curable filling compound and, after complete curing of this compound, the cover element is removed.

It is known that printing plates for rotary gravure printing can be clamped on a gravure printing forme cylinder magnetically or, preferably, mechanically by means of suitable holding and clamping elements. Where wrap-around plates for gravure printing are used, this use being particularly important, the forme cylinder is generally provided for this purpose with a groove which runs parallel with or obliquely to the forme cylinder axis and in which the gravure printing plate is hooked with one or both bent over ends and held firmly. Similar clamping cylinders are described, for example, in Nos. DE-A-25 45 124, DE-A-26 33 445 and DE-A-30 49 143. The resulting gap between the two ends of the gravure printing plate must be closed in a suitable manner for the printing process, in order to prevent penetration and spraying of printing ink and to ensure satisfactory running of the doctor blade. The method generally employed for this purpose to date has comprised introducing a curable filling compound, preferably one consisting of a plastic, from the cylinder surface into the gap and, when the filling compound is completely cured, subjecting the gap region between the plate ends to a surface treatment, for example by sanding, so that a continuous uniform surface is formed in the region of the plate ends (Deutscher Drucker, No. 41/6-11-1975, pages 17 to 22). This is relatively laborintensive and requires manual skill.

No. DE-A-25 45 618 discloses that the gap of a wrap-around plate clamped magnetically on a gravure forme cylinder can be closed by covering the groove by means of a shaped bar up to the cylinder surface and injecting a rapidly curing two-component mixture, in particular an epoxy, polyester or acrylic resin mixture into the resulting groove cavity. In this case, the shaped bar has to be worked very exactly to the particular curvature of the surface of the gravure printing cylinder, which is difficult and very expensive. Special shaped bars are required for each different cylinder i.e. the cylinder size cannot be changed directly. Moreover, it is very difficult to compensate for fluctuations in the tolerances in the wrap-around plates; however, this is necessary for exact closing of the gap.

To overcome the disadvantages associated with these conventional methods, U.S. Pat. No. 4,515,375 proposes a method for closing the gap between the ends of a gravure printing plate clamped on a forme cylinder, in which the gap is covered flush with the adjacent surfaces of the said plate by means of a sheet-like element, in particular a resilient flexible plate, lying on the two end sections of the gravure printing plate, by pressing this sheet-like element onto the surface of the said plate, the resulting gap cavity is filled with a curable filling material and, when the filling material is completely cured, the cover is removed. This method permits the gap to be closed in a simple manner and with little expense, regardless of the particular size of the forme cylinder and any fluctuations in thickness tolerances of the clamped gravure printing plate, since, when pressed to the surface of the gravure printing plate, the flexible sheet-like element with which the gap cavity is covered adopts a curvature which corresponds exactly to that of the surface of the end sections of the clamped gravure printing plate. However, we have found that when clamping cylinders are used in which one or both of the pointed edges of the groove are in the form of a movable or rotatable clamping jaw for the gravure printing plate, the two pointed edges for hooking in the bent over plate ends frequently do not lie exactly opposite one another but are somewhat mutually displaced in a radial direction. These clamping cylinders thus do not have an ideal curvature in the region of the groove (over the entire length or only a part of the axial length) but more or less pronounced ledges are found here. In these cases, mechanical after-treatment of the closed gap may be necessary even where the method described in U.S. Pat. No. 4,515,375 has been used. In other cases, it may be desirable to provide the closed gap with a hollow channel (cf. No. DE-A-25 45 618). Here too, a special procedure is required for gap closure when the conventional and proposed methods are used.

It was an object of the present invention to improve the conventional and proposed methods for closing the gaps between the end or edge regions of gravure printing plates clamped on forme cylinders of rotary gravure presses in such a way that the resulting method is simple to carry out and universally applicable but at the same time ensures a gap closure of high quality.

We have found that this object is achieved, according to the invention, by a method of the type stated at the outset, wherein a cover element is used in which at least that region of the surface which lies on the end or edge sections of the gravure printing plate and covers the gap can be deformed under pressure and hence adapted to the surface contour in the gap region.

The present invention accordingly relates to a method for closing the gaps between the end or edge regions of gravure printing plates clamped on forme cylinders, wherein the gap is covered flush with the adjacent surface sections of the gravure printing plate by means of a cover element by placing the latter on the end or edge sections of the said plate and pressing the said element to the surface of the gravure printing plate, the resulting gap cavity is filled with a curable filling compound and, when this compound is completely cured, the cover element is removed. In the method according to the invention, a cover element is used in which at least that surface region which lies on the end or edge sections of the gravure printing plate and covers the gap can be deformed under pressure and hence adapted to the surface contour in the gap region.

The novel measures make it possible for any gap in the surface region of gravure printing plates clamped on forme cylinders to be closed thoroughly and permanently in a simple manner without a mechanical after-treatment being required, regardless whether the gap region exhibits, in the radial and/or axial directions, irregularities in the surface contour and deviations from the ideal cylindrical shape of the forme cylinder. Depending on the character of the cover element employed and the special conditions of the method, it is also possible to match the surface of the gap to the curvature of the surface of the clamped gravure printing plate and to shape it in the form of a channel or in some other desired form. The novel method can be applied just as advantageously to clamped wrap-around gravure printing plates where there is only one axial gap between the ends of the plate extending over the entire cylinder width, as well as to cylinders on which a plurality of gravure printing plates are clamped one behind the other and side by side and there are therefore also gaps to be closed in the periphery between the lateral edges of the individual plates.

The cover elements used according to the invention can be of various forms. It is essential that at least the surface or the surface region of the cover element which covers the gap of the clamped gravure printing plate can be deformed under pressure and hence adapted to the contour of the gap region. Of course, the entire cover element must be sufficiently stable to allow it to be pressed sufficiently firmly to the surface of the clamped gravure printing plate in order to ensure tight closure of the covered gap cavity. Transparent cover elements are particularly advantageous since they substantially facilitate observation during filling of the gap cavity with the curable filling compound and during curing of this compound. Where photocurable filling compounds are used, it is also possible to expose the filling compound to actinic light through the cover element in order to effect curing, without removing the said element.

In an embodiment of the invention, the cover elements can be of solid form, examples of suitable cover elements being extrudates having a circular or rectangular cross-section or other profiled pieces which cover the gap between the end or edge regions of the clamped gravure printing plates over a sufficient width and over the entire length and which consist of a material which can be deformed under pressure, e.g. silicone rubber, foams or the like.

In another, very advantageous embodiment of the invention, suitable cover elements are hollow bodies which contain a pressure-generating and pressure-transmitting medium which may be connected to a pressure source. Examples of suitable cover elements of this type are hoses, balloons and the like, and multi-sided rigid, e.g. box-shaped, elements which cover the gap and in which only that surface which lies on the end or edge sections of the gravure printing plate and covers the gap consists of a material which is deformable under pressure, for example a rubber-like or elastomeric material or, in particular, a film which can be altered in its stretched state.

Other expedient and advantageous embodiments of the novel method are found in the description below, in which the invention is illustrated with reference to illustrative examples shown schematically in the drawing.

Figure 1:
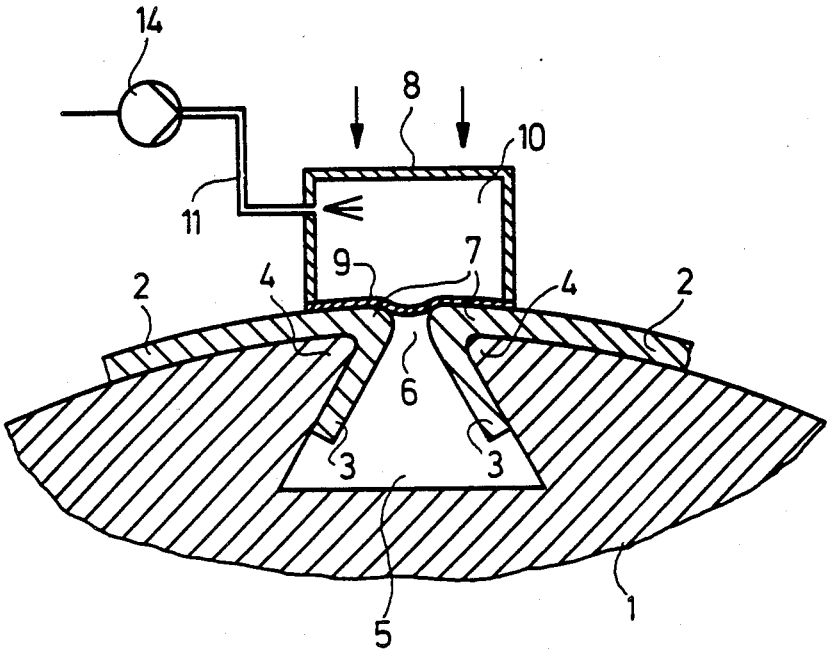
FIG. 1 shows a section of a forme cylinder in the region of the groove, with a clamped gravure printing plate, and, in cross-section, a positioned cover element having a deformable lateral surface.

A gravure printing plate 2 is clamped on the forme cylinder 1 of a sheet-fed or web-fed rotary gravure press. This is achieved, as shown in FIG. 1, by virtue of the fact that the two bent over ends 3 of the gravure printing plate 2 are hooked over the pointed edges 4 into the groove 5 of the forme cylinder 1. The said groove 5 runs either parallel or at a slight angle, e.g. about 2°–5°, to the forme cylinder axis and can, as shown in the example, widen from the cylinder surface towards the center of the cylinder, so that the bent over ends 3 of the gravure printing plate 2 are hooked into the groove 5 at an acute angle. However, the lateral surfaces of the groove 5 may furthermore run parallel to one another either at right angles or obliquely with respect to the cylinder surface, so that the ends 3 of gravure printing plate 2 may also be bent over at right angles or at another angle. Depending on the design of the forme cylinder 1, it is also possible for any one end 3 of the gravure printing plate 2 to be hooked into the groove 5. To close the gap 6 formed between the ends of the gravure printing plate 2 clamped on the forme cylinder 1, a cover element 8 is placed on the end sections 7 of the said plate 2, the said element 8 lying on the end sections 7 of the gravure printing plate 2 and covering the gap 6 over its entire axial length. During closing of the gap 6, the cover element 8 is pressed onto the surface of the gravure printing plate, for example with the aid of a hold-down apparatus not shown in the drawing.

FIG. 1 illustrates the use of a rigid, box-shaped cover element 8 whose surface 9 which lies on the end sections 7 of the gravure printing plate 2 consists of a material which can be deformed under pressure. Materials which are suitable for this purpose are not only, for example, elastic films, such as elastomeric membranes or the like, but also other films, in particular those made of plastic, which are movably clamped on the box-shaped cover element 8 and can be advantageously altered in their stretched state. Depending on their stretched state, the films clamped in this manner can be stretched tautly by means of internal and/or external pressure and can hence be matched up with, and pressed onto, the surface contours in the region of the gap 6, with simultaneous formation of a tight cover flush with the edge regions 7 of the gravure printing plate 2. The cavity 10 of the cover element 8 is filled with a pressure-generating and pressure-transmitting medium and advantageously connected to a pressure source 14 via a line 11. Examples of suitable pressure-generating and pressure-transmitting media are liquids such as water, oil or the like, but in particular air or other gases.

Figure 2:
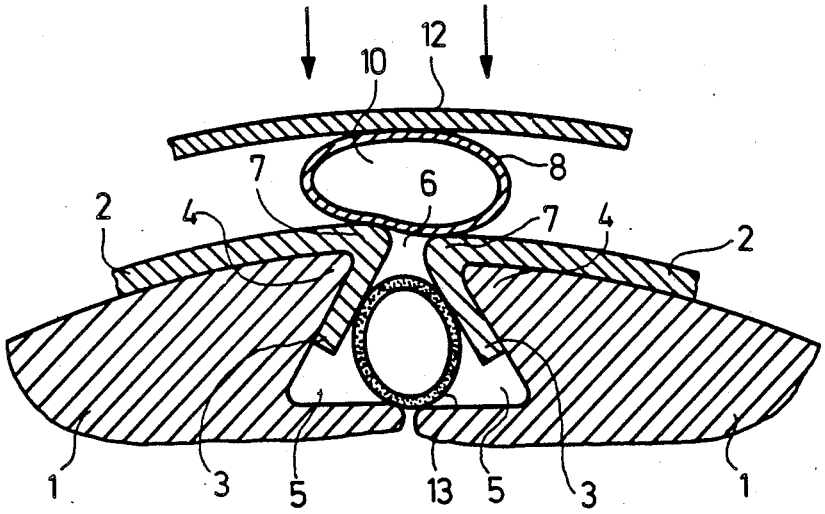
FIG. 2 shows a forme cylinder as in FIG. 1 but with a sealing element arranged in the groove cavity, and a completely deformable cover element.

FIG. 2 illustrates schematically the covering of the gap 6 between the end sections 7 of a gravure printing plate 2 clamped on a forme cylinder 1, by means of a completely deformable cover element 8. The cover element 8 in this case is a hollow body, for example a hose, whose cavity 10 is filled with a pressure-transmitting medium, for example a liquid such as water or oil, but in particular with air or another gas. The cover element 8 is pressed, by means of a suitable pressure element 12 onto the end sections 7 of the clamped gravure printing plate 2 so as to cover the gap 6. Examples of very advantageous pressure elements 12 are resilient flexible sheets which are preferably transparent and consist of, for example, plastic. In this case, the pressure with which the cover element 8 is pressed to the surface of the clamped gravure printing plate by means of the pressure element 12 is determined decisively by the internal pressure of the pressure-transmitting medium in the cavity 10 of the said cover element 8 and by the shape desired for the surface of the closed gap. If desired, the cavity 10 of the hose-like cover element 8, as shown in FIG. 1, can be connected to a pressure source via a line so that in this case it is also possible to control the internal pressure of the cover element 8 and hence to exercise more substantial control over the matching of the cover element 8 to the surface contours in the region of the gap 6, with adjustment of the closed gap to get the desired surface in a selective manner.

To close the gap 6, the gap cavity formed after the said gap has been covered with the cover element 8 is filled with a curable filling compound. Suitable filling compounds are the materials which are conventionally used for closing gaps and which, in the cured state, are resistant to the printing ink solvents. These include not only conventional thermoplastics but also, advantageously, hotmelt adhesives based on, for example, polyvinyl acetate, nylon, polyesters or thermoplastics such as polyolefins, styrene/butadiene and/or isoprene block copolymers etc. Heat curable or, in particular, photocurable reactive resins, e.g. epoxy resins, acrylic resins, isocyanate resins, silicone resins, UP resins etc. are also suitable. Other very advantageous filling compounds are free-flowing, solvent-free photopolymerizable mixtures based on photopolymerizable monomers, one or more polymeric binders, a photoinitiator and, if required, fillers and further additives. The material for that surface of the cover element 8 which covers the gap 6 is chosen with regard to the curable filling compound used, so that, after curing of the filling compound, the cover element 8 can be removed easily from the surface of the gravure printing plate 2 and from the cured gap filling. If necessary, the surface of the cover element 8 can be coated with a parting agent, for example siliconized, or a thin separating film can be placed between the end sections 7 of the gravure printing plate 2 and that surface of the cover element 8 which lies on this.

To prevent the curable filling compound from penetrating into the interior of the forme cylinder 1, in particular into any clamping apparatuses and elements, the groove cavity 5 is sealed tightly on the inside in a radial direction, i.e. towards the center of the cylinder. This closure of the groove cavity 5 in a radial direction towards the inside can be effected and secured by purely structural features of the forme cylinder 1, as shown diagrammatically in FIG. 1. In the case of clamp cylinders in which in general one of the pointed edges 4 is arranged movably via a clamping jaw, and the groove cavity 5 is therefore not closed towards the inside of the cylinder (FIG. 2), the said cavity 5 can be closed in a radial direction towards the inside by using a sealing element 13 which is inserted into the groove cavity 5 and extends over its entire length. This sealing element 13 can be compact or, as shown in the drawing, a hollow body, preferably having a circular cross-section, for example a hose made of silicone rubber. Where such hollow bodies are used as sealing element 13, these can be connected via a further line (not shown in the drawing) to a pressure source and can therefore be blown up. Consequently, both a safe and reliable seal can be obtained and any shrinkage of filling material which occurs during curing can be compensated. If the sealing element 13 in the form of a hollow body is provided not only with a feed line but also an outlet line, this element can be connected in a heating medium or coolant cycle under pressure so that, depending on the filling material used, it is furthermore possible to control and influence the flow behavior of the filling material during filling of the gap 6 and/or the curing of the filling material after the gap 6 has been filled.

The gap cavity covered with the cover element 8 is advantageously filled with the curable filling compound from the end face of the forme cylinder via one or more inlets arranged in its bearing housings. To do this, the free-flowing curable filling compound is injected into the gap cavity by means of a metering apparatus. In a very advantageous version of the method, the said filling compound may also be introduced through a hollow body 13 which lies in the groove cavity 5 and is provided, along the gap 6, with one or more small openings leading into the cavity of the gap 6. Rapid, uniform distribution of the filling compound is thus ensured, which is important for satisfactory gap closure. For example, it has proven advantageous to introduce the filling compound into the cavity of the covered gap 6 through an opening which is located roughly in the middle along the length of the hollow body 13. In this version of the method, any pressure required in the hollow body 13 to produce reliable sealing of the groove cavity 5 radially toward the center of the cylinder can be generated by means of the filling compound in the hollow body 13. Furthermore, the air present in the gap is expelled through the two ends of the gap, which only come into contact with the filling compound at the end of the injection process.

The pressure under which the surface of the cover element 8 covering the gap 6 is pressed onto the end sections 7 of the gravure printing plate 2 is of course greater than the pressure exerted on the cover element 8 from the gap side by injecting the curable filling compound. This ensures that the gap 6 is covered flush and tight toward the outside. Because the surface of the cover element 8 covering the gap 6 is deformable under pressure, this surface fits the surface contours in the gap region. In the case of solid cover elements 8, the material of that surface of the cover element which lies on the end sections of the gravure printing plate is therefore chosen so that it is deformable under the pressure exerted on the cover element and can be matched up with the surface contour in the gap region but is not altered by the opposing pressure exerted by the curable filling compound injected into the gap cavity. Depending on the pressure under which the cover element is pressed onto the gravure printing plate, the surface of the gap filled with the filling compound can in this case be varied within certain limits and adapted to the particular shapes desired. In the case of cover elements which are in the form of hollow bodies and contain a pressure-generating and pressure-transmitting medium, the surface of the gap 6 filled with the filling compound is also controlled essentially by the internal pressure which exists in the cavity 10 of the cover element 8. Thus, as shown in FIG. 1, gap closure can be effected very readily and simply by means of a channel if the pressure in the cavity 10 of the cover element 8 is appropriately high. In this case, the movable, deformable surface 9 of the cover element 8 is not only pressed firmly onto, and flush with, the end sections 7 of the gravure printing plate 2 but also arched slightly outward into the gap 6, so that, after closure with the curable filling compound, a slightly concave surface results in the gap region. Even in cases in which the pointed edges 4 of forme cylinder 1 are not located exactly opposite one another, as frequently occurs with clamping cylinders, but are mutually displaced, possibly to different extents, in the vertical direction over the length of the forme cylinder axis, the cover elements used in the novel method give a satisfactory gap closure since, when pressed onto the surface, these cover elements fit the surface contours in the gap region in any desired shape, as can be seen from FIG. 2. In this case too, by suitably matching the external pressure on the cover element 8 with the internal pressure of the pressure-generating and pressure-transmitting medium in the cavity 10 of the cover element 8, the surface contour of the closed gap can be varied in a suitable and desired manner, especially if a cover element 8 is used whose cavity 10 is connected to an external pressure source by means of which the internal pressure in the cavity 10 can be controlled independently.

When the covered gap cavity has been filled with the filling compound, the latter is cured. This is done in the case of thermoplastics by cooling the polymers introduced in melt form, and in the case of heat-curable reactive resins by supplying heat in a suitable manner, the heat sources being arranged inside or above the gap cavity. In the case of photocurable reactive resins and photopolymerizable filling compounds, curing is effected by exposure to actinic light, and the usual sources of actinic light can be used. Since these sources are generally arranged above the gap filled with the filling compound, and curing of the latter is carried out in general while the cover element is still in position on the end sections of the gravure printing plate and is pressed onto this, particularly suitable covering elements where photocurable and photopolymerizable filling compounds are used are those which are transparent to actinic light. Thus, exposure and curing of the filling compound filling the gap can be effected through the cover element while the latter is still in position. In these cases, the pressure element (FIG. 2) also used for completely deformable cover elements is also transparent. However, it is in general preferable to use transparent cover elements since this generally also facilitates observation of the filling of the gap with the curable filling compound and hence inspection during closing of the gap. After curing of the filling compound which fills the gap, the cover element is removed from the cylinder surface.

Using the novel method, the gaps which result when gravure printing plates are clamped on forme cylinders can be closed in a simple manner so that, during printing on sheet-fed and in particular web-fed rotary gravure presses, no problems are encountered, particularly with regard to the behavior of the doctor blade, spraying of ink or impressions of the gap. Subsequent mechanical processing of the gap closure is unnecessary even in the case of forme cylinders which have not been exactly finished in the region of the groove. Instead, the novel method permits the surface contour of the closed gap to be shaped and formed in the desired manner directly during closing of the gap, without separate operation. The resulting gap closure is strong and durable and permits the long print runs required in gravure printing. Another particular advantage of the novel method is that the gaps running along the circumference of the cylinder, as are formed, for example, when a plurality of gravure printing plates are clamped side by side on a cylinder, can readily be closed.

In the method according to the invention, all conventional gravure printing plates which can be clamped on the forme cylinder of a sheet-fed or web-fed rotary gravure press, in particular wrap-around gravure printing plates, can be employed. These include the conventional metal gravure printing plates possessing a Ballard skin and, particularly advantageously, the gravure printing plates which possess plastic printing layers and in which a plastic layer is applied on a suitable support, in which plastic layer the ink-receiving depressions (wells) have been introduced by mechanical engraving or engraving with a laser (cf. for example Nos. DE-A-27 52 500 or DE-A-30 28 098) or photomechanically by imagewise exposure and development of a suitable photosensitive recording material (cf. for example Nos. DE-A-20 54 833, DE-A-20 61 287, EP-A-70 510 and EP-A-70 511). It is of course also possible for the wells to be introduced into the gravure printing plate only after the latter has been clamped on the forme cylinder and after the gap has been closed. For the purposes of the present invention, gravure printing plates are therefore both printing plates already possessing wells and printing plate blanks in which the wells have not yet been formed.

To remove the gravure printing plates from the forme cylinder when the printing process is complete, the filling in the gap between the plate ends can be detached again by mechanical means or by tearing it out by means of a previously inserted wire.

We claim:

1. A method of closing the gap between the end or edge regions of a gravure printing plate clamped on a forme cylinder which comprises: applying a cover element in the form of a hollow body containing a pressure generating and pressure transmitting fluid to the gap, said cover element having a pressure deformable surface at least in the region which lies on the end or edge sections of the plate; exerting pressure on the deformable surface of the cover element by means of said pressure generating and transmitting fluid, whereby the cover element is deformed and assumes the surface contour of the plate in the gap region; filling the resulting gap cavity with a curable filling compound; curing the compound and thereafter removing the cover element.

2. The method of claim 1, wherein the pressure in the interior of the cover element is controlled via an external pressure source connected to the cavity of the cover element.

3. The method as claimed in claim 1, wherein a cover element which can be completely deformed under pressure is employed.

4. The method of claim 3, wherein a hose-shaped or profile-shaped cover element is employed.

5. The method of claim 1, wherein a solid box-shaped cover element is employed, whose surface which lies on the end or edge sections of the gravure printing plate and covers the gap consists of a material which is deformable under pressure and can be adapted to the surface contours in the gap region.

6. The method of claim 1, wherein a transparent cover element is used.

7. The method of claim 1, wherein the pressure transmitting fluid within the cover element is a gas.

8. The method of claim 7, wherein the gas is air.

* * * * *